US008201628B2

(12) United States Patent
Lovorn et al.

(10) Patent No.: US 8,201,628 B2
(45) Date of Patent: Jun. 19, 2012

(54) WELLBORE PRESSURE CONTROL WITH SEGREGATED FLUID COLUMNS

(75) Inventors: James R. Lovorn, Tomball, TX (US); Emad Bakri, Houston, TX (US); Jay K. Turner, Humble, TX (US); Ryan G. Ezell, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/084,841

(22) Filed: Apr. 12, 2011

(65) Prior Publication Data

US 2011/0259612 A1 Oct. 27, 2011

(51) Int. Cl.
*E21B 21/00* (2006.01)
*E21B 21/08* (2006.01)
*E21B 33/13* (2006.01)

(52) U.S. Cl. ..... 166/292; 166/53; 166/285; 166/290; 166/294; 166/387; 175/25; 175/72

(58) Field of Classification Search ..... None
See application file for complete search history.

(56) References Cited

U.S. PATENT DOCUMENTS

| | | | | | |
|---|---|---|---|---|---|
| 2,223,397 | A | * | 12/1940 | White et al. | 166/282 |
| 4,275,788 | A | * | 6/1981 | Sweatman | 166/292 |
| 4,387,770 | A | * | 6/1983 | Hill | 166/305.1 |
| 4,468,056 | A | | 8/1984 | Kramer et al. | |
| 4,626,135 | A | | 12/1986 | Roche | |
| 4,627,496 | A | * | 12/1986 | Ashford et al. | 166/292 |
| 4,813,495 | A | | 3/1989 | Leach | |
| 4,819,727 | A | * | 4/1989 | Jennings, Jr. | 166/292 |
| 5,327,973 | A | * | 7/1994 | Jennings, Jr. | 166/307 |
| 5,529,123 | A | * | 6/1996 | Carpenter et al. | 166/293 |
| 5,720,356 | A | | 2/1998 | Gardes | |
| 5,771,971 | A | | 6/1998 | Horton et al. | |
| 5,771,974 | A | | 6/1998 | Stewart et al. | |
| 6,053,252 | A | | 4/2000 | Edwards | |
| 6,065,550 | A | | 5/2000 | Gardes | |
| 6,102,673 | A | | 8/2000 | Mott et al. | |

(Continued)

FOREIGN PATENT DOCUMENTS

EP 1432887 B1 3/2003

(Continued)

OTHER PUBLICATIONS

International Search Report and Written Opinion issued Feb. 12, 2009, for International Patent Application No. PCT/US08/87686, 7 pages.

(Continued)

*Primary Examiner* — George Suchfield
(74) *Attorney, Agent, or Firm* — Smith IP Services, P.C.

(57) ABSTRACT

A method of controlling pressure in a wellbore can include placing a barrier substance in the wellbore while a fluid is present in the wellbore, and flowing another fluid into the wellbore while the first fluid and the barrier substance are in the wellbore. The first and second fluids may have different densities. Another method can include circulating a fluid through a tubular string and an annulus formed between the tubular string and the wellbore, then partially withdrawing the tubular string from the wellbore, then placing a barrier substance in the wellbore, then partially withdrawing the tubular string from the wellbore and then flowing another fluid into the wellbore. A well system can include at least two fluids in a wellbore, the fluids having different densities, and a barrier substance separating the fluids.

18 Claims, 4 Drawing Sheets

U.S. PATENT DOCUMENTS 6,138,774 A 10/2000 Bourgoyne, Jr. et al.
6,145,591 A * 11/2000 Boncan et al. ..... 166/291
6,230,824 B1 5/2001 Peterman et al.
6,263,982 B1 7/2001 Hannegan et al.
6,273,193 B1 8/2001 Hermann et al.
6,325,159 B1 12/2001 Peterman et al.
6,328,107 B1 12/2001 Maus
6,450,262 B1 9/2002 Regan
6,454,022 B1 9/2002 Sangesland et al.
6,457,540 B2 10/2002 Gardes
6,470,975 B1 10/2002 Bourgoyne et al.
6,527,062 B2 3/2003 Elkins et al.
6,571,873 B2 6/2003 Maus
6,598,682 B2 7/2003 Johnson et al.
6,732,798 B2 5/2004 Johnson et al.
6,732,804 B2 5/2004 Hosie et al.
6,739,397 B2 5/2004 Ayling
6,745,857 B2 6/2004 Gjedebo
6,802,379 B2 10/2004 Dawson et al.
6,840,322 B2 1/2005 Haynes et al.
6,904,981 B2 6/2005 Van Riet
6,913,092 B2 7/2005 Bourgoyne et al.
6,920,085 B2 7/2005 Finke et al.
6,981,561 B2 1/2006 Krueger et al.
7,023,691 B1 4/2006 Feight et al.
7,032,691 B2 4/2006 Humphreys
7,044,237 B2 5/2006 Leuchtenberg
7,055,627 B2 6/2006 Fontana et al.
7,073,591 B2 7/2006 Massie et al.
7,080,685 B2 7/2006 Bailey et al.
7,093,662 B2 8/2006 De Boer
7,096,975 B2 8/2006 Aronstam et al.
7,134,489 B2 11/2006 Van Riet
7,158,886 B2 1/2007 Hou et al.
7,159,669 B2 1/2007 Bourgoyne et al.
7,174,975 B2 2/2007 Krueger et al.
7,185,718 B2 3/2007 Gardes
7,185,719 B2 3/2007 Van Riet
7,258,171 B2 8/2007 Bourgoyne et al.
7,264,058 B2 9/2007 Fossli
7,270,185 B2 9/2007 Fontana et al.
7,278,496 B2 10/2007 Leuchtenberg
7,350,597 B2 4/2008 Reitsma et al.
7,353,887 B2 4/2008 Krueger et al.
7,367,410 B2 5/2008 Sangesland
7,367,411 B2 5/2008 Leuchtenberg
7,395,878 B2 7/2008 Reitsma et al.
7,497,266 B2 3/2009 Fossli
7,513,310 B2 4/2009 Fossli
7,562,723 B2 7/2009 Reitsma
7,650,950 B2 1/2010 Leuchtenberg
7,658,228 B2 2/2010 Moksvold
7,677,329 B2 3/2010 Stave
7,708,064 B2 5/2010 Sehsah
7,721,822 B2 5/2010 Krueger et al.
7,762,329 B1 * 7/2010 Morgan et al. ..... 166/295
7,806,203 B2 10/2010 Krueger et al.
2002/0112888 A1 8/2002 Leuchtenberg
2003/0066650 A1 4/2003 Fontana et al.
2003/0089498 A1 5/2003 Johnson et al.
2003/0098181 A1 5/2003 Aronstam et al.
2003/0111799 A1 6/2003 Gilmore
2004/0124008 A1 7/2004 Fincher et al.
2004/0178001 A1 9/2004 Bourgoyne et al.
2004/0206548 A1 10/2004 Aronstam et al.
2005/0061546 A1 3/2005 Hannegan
2005/0092522 A1 5/2005 Humphreys
2006/0021755 A1 2/2006 Radi et al.
2006/0065402 A9 3/2006 Fontana et al.
2006/0070772 A1 4/2006 De Boer et al.
2006/0086538 A1 4/2006 Van Riet
2006/0102387 A1 5/2006 Bourgoyne et al.
2006/0124300 A1 6/2006 Steiner et al.
2006/0169491 A1 8/2006 Fossli
2006/0185857 A1 8/2006 York et al.
2006/0191716 A1 8/2006 Humphreys
2007/0068704 A1 3/2007 Krueger et al.
2007/0240875 A1 10/2007 Van Riet
2007/0278007 A1 12/2007 Krueger et al.
2008/0223596 A1 9/2008 Ezell et al.
2008/0227665 A1 9/2008 Ezell et al.
2009/0211239 A1 8/2009 Askeland
2010/0006297 A1 1/2010 Stave
2011/0009298 A1 1/2011 Dobson, Jr. et al.

FOREIGN PATENT DOCUMENTS

EP 1488073 B1 8/2003
EP 1240404 B1 12/2003
EP 1595057 B1 9/2004
EP 1071862 B1 11/2004
EP 1664478 B1 2/2005
EP 1356186 B1 6/2005
EP 2053196 A1 4/2009
WO 9942696 A1 8/1999
WO 01/65060 A1 9/2001
WO 0183941 A1 11/2001
WO 0190528 A1 11/2001
WO 02/50398 A1 6/2002
WO 0244518 A1 6/2002
WO 03025334 A8 3/2003
WO 03025336 A1 3/2003
WO 03071091 A9 8/2003
WO 2004005667 A1 1/2004
WO 2004074627 A1 9/2004
WO 2004085788 A3 10/2004
WO 2005001237 A1 1/2005
WO 2005017308 A1 2/2005
WO 2005/042917 A1 5/2005
WO 2006029379 A1 3/2006
WO 2006031119 A1 3/2006
WO 2006099362 A1 9/2006
WO 2006118920 A3 11/2006
WO 2006138565 A1 12/2006
WO 2007/008085 A1 1/2007
WO 2007008085 A1 1/2007
WO 2007016000 A1 2/2007
WO 2007030017 A1 3/2007
WO 2007081711 A3 7/2007
WO 2007112291 A3 10/2007
WO 2007124330 A3 11/2007
WO 2008133523 A1 11/2008
WO 2008134266 A1 11/2008
WO 2008151128 A9 12/2008
WO 2008156376 A1 12/2008
WO 2009017418 A1 2/2009
WO 2009018448 A2 2/2009
WO 2009058706 A2 5/2009
WO 2009086442 A3 7/2009
WO 2009123476 A1 10/2009
WO 2010065646 A3 6/2010
WO 2010095947 A1 8/2010

OTHER PUBLICATIONS

International Search Report and Written Opinion issued Sep. 22, 2008, for International Patent Application No. PCT/US07/83974, 16 pages.
International Preliminary Report on Patentability issued May 22, 2009, for International Patent Application Serial No. PCT/US07/83974, 13 pages.
International Search Report and Written Opinion issued Jan. 25, 2011, for International Patent Application Serial No. PCT/US10/032578, 9 pages.
Halliburton; "N-SOLATE Thermally Insulating Packer Fluid Systems", company slideshow, dated 2007, 22 pages.
Halliburton; "N-SOLATE Packer Fluids", H05923, dated Aug. 2008, 2 pages.
US 6,708,780, 03/2004, Bourgoyne et al. (withdrawn)

* cited by examiner

WELLBORE PRESSURE CONTROL WITH SEGREGATED FLUID COLUMNS

CROSS-REFERENCE TO RELATED APPLICATION

This application claims the benefit under 35 USC §119 of the filing date of International Application Serial No. PCT/US10/32578, filed Apr. 27, 2010. The entire disclosure of this prior application is incorporated herein by this reference.

BACKGROUND

The present disclosure relates generally to equipment and fluids utilized and operations performed in conjunction with a subterranean well and, in an embodiment described herein, more particularly provides for wellbore pressure control with segregated fluid columns.

In underbalanced and managed pressure drilling and completion operations, it is beneficial to be able to maintain precise control over pressures and fluids exposed to drilled-through formations and zones. In the past, specialized equipment (such as downhole deployment valves, snubbing units, etc.) have been utilized to provide for pressure control in certain situations (such as, when tripping pipe, running casing or liner, wireline logging, installing completions, etc.)

However, this specialized equipment (like most forms of equipment) is subject to failure, can be time-consuming and expensive to install and operate, and may not be effective in certain operations. For example, downhole deployment valves have been known to leak and snubbing units are ineffective to seal about slotted liners.

Therefore, it will be appreciated that improvements are needed in the art of wellbore pressure control. These improvements could be used in conjunction with conventional equipment (such as downhole deployment valves, snubbing units, etc.), or they could be substituted for such conventional equipment. The improvements could be used in underbalanced and managed pressure drilling and completion operations, and/or in other types of well operations.

DETAILED DESCRIPTION

Figure 1:
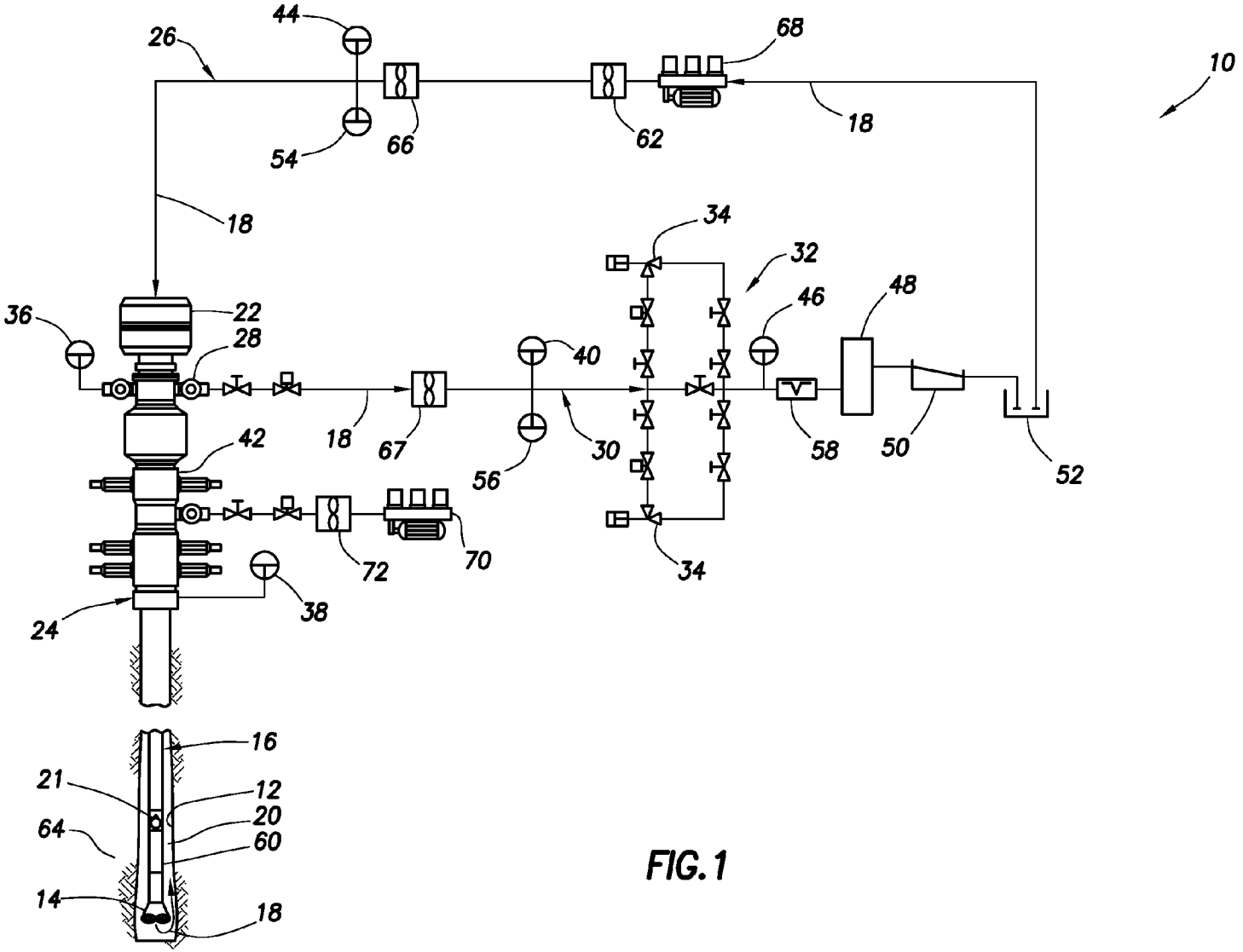
FIG. 1 is a schematic partially cross-sectional view of a well system and associated method which can embody principles of the present disclosure.

Representatively and schematically illustrated in FIG. 1 is a well system 10 and associated method which can embody principles of the present disclosure. In the system 10, a wellbore 12 is drilled by rotating a drill bit 14 on an end of a tubular string 16.

Drilling fluid 18, commonly known as mud, is circulated downward through the tubular string 16, out the drill bit 14 and upward through an annulus 20 formed between the tubular string and the wellbore 12, in order to cool the drill bit, lubricate the tubular string, remove cuttings and provide a measure of bottom hole pressure control. A non-return valve 21 (typically a flapper-type check valve) prevents flow of the drilling fluid 18 upward through the tubular string 16 (e.g., when connections are being made in the tubular string).

Control of bottom hole pressure is very important in managed pressure and underbalanced drilling, and in other types of well operations. Preferably, the bottom hole pressure is accurately controlled to prevent excessive loss of fluid into an earth formation 64 surrounding the wellbore 12, undesired fracturing of the formation, undesired influx of formation fluids into the wellbore, etc.

In typical managed pressure drilling, it is desired to maintain the bottom hole pressure just greater than a pore pressure of the formation 64, without exceeding a fracture pressure of the formation. In typical underbalanced drilling, it is desired to maintain the bottom hole pressure somewhat less than the pore pressure, thereby obtaining a controlled influx of fluid from the formation 64.

Nitrogen or another gas, or another lighter weight fluid, may be added to the drilling fluid 18 for pressure control. This technique is especially useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the tubular string 16 above a wellhead 24. Although not shown in FIG. 1, the tubular string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through fluid return line 30 to a choke manifold 32, which includes redundant chokes 34. Backpressure is applied to the annulus 20 by variably restricting flow of the fluid 18 through the operative choke(s) 34.

The greater the restriction to flow through the choke 34, the greater the backpressure applied to the annulus 20. Thus, bottom hole pressure can be conveniently regulated by varying the backpressure applied to the annulus 20. A hydraulics model can be used, as described more fully below, to determine a pressure applied to the annulus 20 at or near the surface which will result in a desired bottom hole pressure, so that an operator (or an automated control system) can readily determine how to regulate the pressure applied to the annulus at or near the surface (which can be conveniently measured) in order to obtain the desired bottom hole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the fluid return line 30 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 66.

Not all of these sensors are necessary. For example, the system 10 could include only one of the flowmeters 62, 66.

However, input from the sensors is useful to the hydraulics model in determining what the pressure applied to the annulus 20 should be during the drilling operation.

In addition, the tubular string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) sensor systems. These tubular string sensor systems generally provide at least pressure measurement, and may also provide temperature measurement, detection of tubular string characteristics (such as vibration, weight on bit, stick-slip, etc.), formation characteristics (such as resistivity, density, etc.) and/or other measurements. Various forms of telemetry (acoustic, pressure pulse, electromagnetic, optical, wired, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the tubular string 16 by the rig mud pump 68. The pump 68 receives the fluid 18 from the mud pit 52 and flows it via a standpipe manifold (not shown) to the standpipe line 26, the fluid then circulates downward through the tubular string 16, upward through the annulus 20, through the mud return line 30, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the bottom hole pressure, unless the fluid 18 is flowing through the choke. In conventional overbalanced drilling operations, a lack of circulation can occur whenever a connection is made in the tubular string 16 (e.g., to add another length of drill pipe to the tubular string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the tubular string 16 and annulus 20. Thus, pressure can still be applied to the annulus 20 by restricting flow of the fluid 18 through the choke 34.

In the system 10 as depicted in FIG. 1, a backpressure pump 70 can be used to supply a flow of fluid to the return line 30 upstream of the choke manifold 32 by pumping fluid into the annulus 20 when needed. Alternatively, or in addition, fluid could be diverted from the standpipe manifold to the return line 30 when needed, as described in International Application Serial No. PCT/US08/87686, and in U.S. application Ser. No. 12/638,012. Restriction by the choke 34 of such fluid flow from the rig pump 68 and/or the backpressure pump 70 will thereby cause pressure to be applied to the annulus 20.

Although the example of FIG. 1 is depicted as if a drilling operation is being performed, it should be clearly understood that the principles of this disclosure may be utilized in a variety of other well operations. For example, such other well operations could include completion operations, logging operations, casing operations, etc.

Thus, it is not necessary for the tubular string 16 to be a drill string, or for the fluid 18 to be a drilling fluid. For example, the fluid 18 could instead be a completion fluid or any other type of fluid.

Accordingly, it will be appreciated that the principles of this disclosure are not limited to drilling operations and, indeed, are not limited at all to any of the details of the system 10 described herein and/or illustrated in the accompanying drawings.

Figure 2:
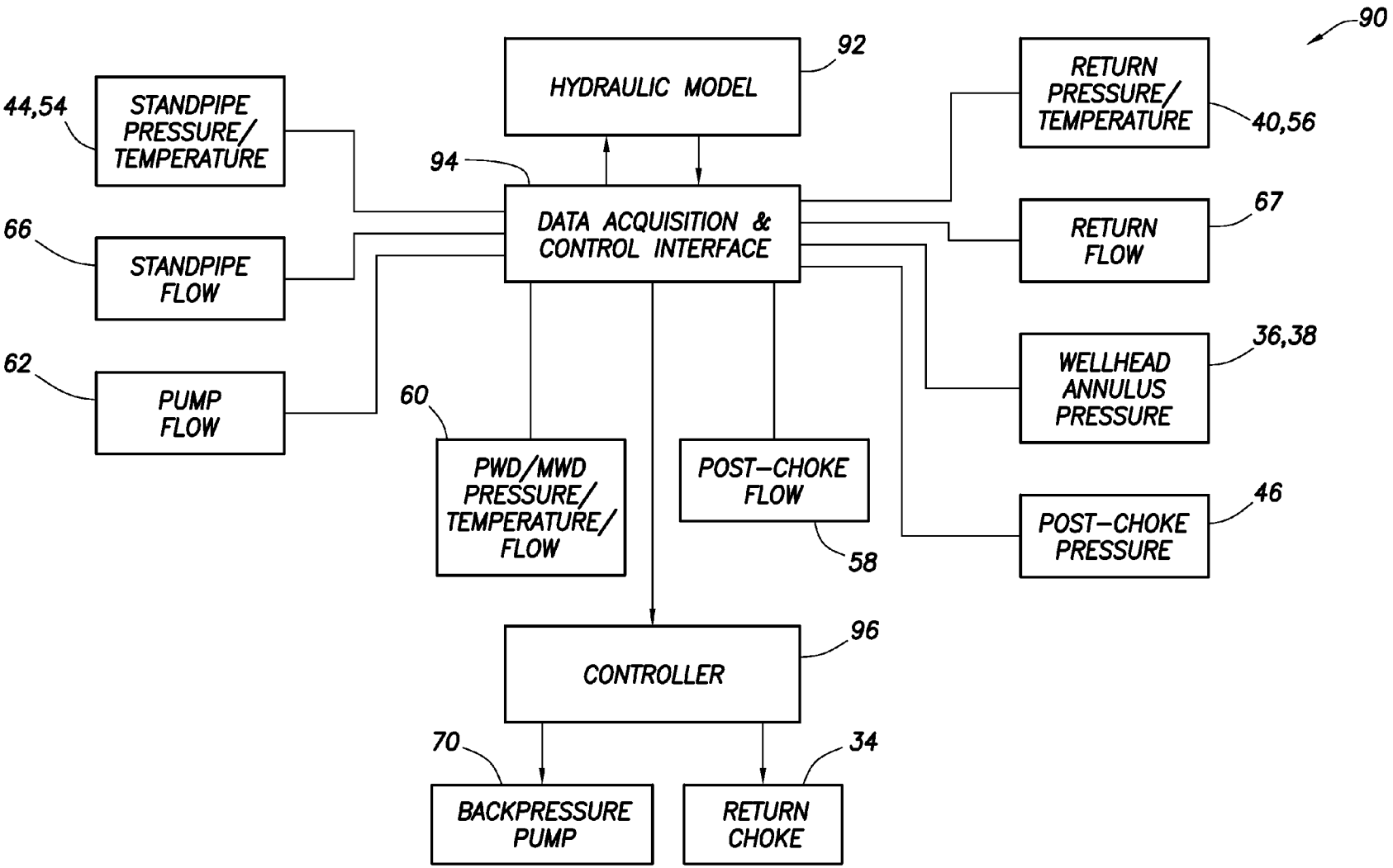
FIG. 2 is a schematic view of a pressure and flow control system which may be used with the well system and method of FIG. 1.

A pressure and flow control system 90 which may be used in conjunction with the system 10 and method of FIG. 1 is representatively illustrated in FIG. 2. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as, a programmable logic controller or PLC, a suitably programmed computer, etc.). Although these elements 92, 94, 96 are depicted separately in FIG. 2, any or all of them could be combined into a single element, or the functions of the elements could be separated into additional elements, other additional elements and/or functions could be provided, etc.

The hydraulics model 92 is used in the control system 90 to determine the desired annulus pressure at or near the surface to achieve the desired bottom hole pressure. Data such as well geometry, fluid properties and offset well information (such as geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. Preferably, the data acquisition and control interface 94 operates to maintain a substantially continuous flow of real-time data from the sensors 36, 38, 40, 44, 46, 54, 56, 58, 60, 62, 64, 66, 67 to the hydraulics model 92, so that the hydraulics model has the information it needs to adapt to changing circumstances and to update the desired annulus pressure. The hydraulics model 92 operates to supply the data acquisition and control interface 94 substantially continuously with a value for the desired annulus pressure.

A greater or lesser number of sensors may provide data to the interface 94, in keeping with the principles of this disclosure. For example, flow rate data from a flowmeter 72 which measures an output of the backpressure pump 70 may be input to the interface 94 for use in the hydraulics model 92.

A suitable hydraulics model for use as the hydraulics model 92 in the control system 90 is REAL TIME HYDRAULICS™ provided by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ provided by Halliburton Energy Services, Inc. Any suitable data acquisition and control interface may be used in the control system 90 in keeping with the principles of this disclosure.

The controller 96 operates to maintain a desired setpoint annulus pressure by controlling operation of the fluid return choke 34 and/or the backpressure pump 70. When an updated desired annulus pressure is transmitted from the data acquisition and control interface 94 to the controller 96, the controller uses the desired annulus pressure as a setpoint and controls operation of the choke 34 in a manner (e.g., increasing or decreasing flow through the choke as needed) to maintain the setpoint pressure in the annulus 20.

This is accomplished by comparing the setpoint pressure to a measured annulus pressure (such as the pressure sensed by any of the sensors 36, 38, 40), and increasing flow through the choke 34 if the measured pressure is greater than the setpoint pressure, and decreasing flow through the choke if the measured pressure is less than the setpoint pressure. Of course, if the setpoint and measured pressures are the same, then no adjustment of the choke 34 is required. This process is preferably automated, so that no human intervention is required, although human intervention may be used if desired.

The controller 96 may also be used to control operation of the backpressure pump 70. The controller 96 can, thus, be used to automate the process of supplying fluid flow to the return line 30 when needed. Again, no human intervention may be required for this process.

Figure 3:
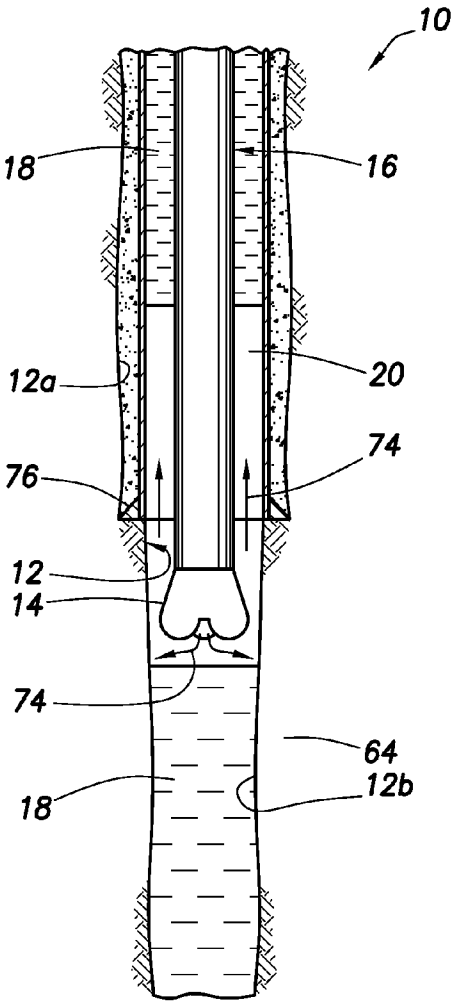
FIG. 3 is a schematic cross-sectional view of the well system in which initial steps of the method have been performed.

Referring additionally now to FIG. 3, a somewhat enlarged scale view of a portion of the well system 10 is representatively illustrated apart from the remainder of the system depicted in FIG. 1. In the FIG. 3 illustration, both cased 12*a* and uncased 12*b* portions of the wellbore 12 are visible.

In the example of FIG. 3, it is desired to trip the tubular string 16 out of the wellbore 12, for example, to change the bit 14, install additional casing, install a completion assembly, perform a logging operation, etc. However, it is also desired to prevent excessively increased pressure from being applied to the uncased portion 12*b* of the wellbore exposed to the formation 64 (which could result in skin damage to the formation, fracturing of the formation, etc.), to prevent excessively reduced pressure from being exposed to the uncased portion of the wellbore (which could result in an undesired influx of fluid into the wellbore, instability of the wellbore, etc.), to prevent any gas in the fluid 18 from migrating upwardly through the wellbore, and to prevent other fluids (such as higher density fluids) from contacting the exposed formation.

In one unique feature of the example depicted in FIG. 3, the tubular string 16 is partially withdrawn from the wellbore 12 (e.g., raised in the vertical wellbore shown in FIG. 3) and a barrier substance 74 is placed in the wellbore. The barrier substance 74 may be flowed into the wellbore 12 by circulating it through the tubular string 16 and into the annulus 20, or the barrier substance could be placed in the wellbore by other means (such as, via another tubular string installed in the wellbore, by circulating the barrier substance downward through the annulus, etc.).

As illustrated in FIG. 3, the barrier substance 74 is placed in the wellbore 12 so that it traverses the junction between the cased portion 12*a* and uncased portion 12*b* of the wellbore (i.e., at a casing shoe 76). However, in other examples, the barrier substance 74 could be placed entirely in the cased portion 12*a* or entirely in the uncased portion 12*b* of the wellbore 12.

The barrier substance 74 is preferably of a type which can isolate the fluid 18 exposed to the formation 64 from other fluids in the wellbore 12. However, the barrier substance 74 also preferably transmits pressure, so that control over pressure in the fluid 18 exposed to the formation 64 can be accomplished using the control system 90.

To isolate the fluid 18 exposed to the formation 64 from other fluids in the wellbore 12, the barrier substance 74 is preferably a highly viscous fluid, a highly thixotropic gel or a high strength gel which sets in the wellbore. However, the barrier substance 74 could be (or comprise) other types of materials in keeping with the principles of this disclosure.

One suitable highly thixotropic gel for use as the barrier substance 74 is N-SOLATE™ provided by Halliburton Energy Services, Inc. A suitable preparation is as follows:

N-SOLATE™ Base A base fluid(glycerol)–0.70 lb/bbl
Water (freshwater)–0.30 lb/bbl N-SOLATE™ 600 Vis viscosifier–10.0 lb/bbl One suitable high strength gel for use as the barrier substance 74 may be prepared as follows:

N-SOLATE™ Base A base fluid(glycerol)–0.73 lb/bbl

N-SOLATE™ 275 Vis viscosifier–0.15 lb/bbl

N-SOLATE™ 275 X-link cross linker–0.04 lb/bbl

Water(freshwater)–0.08 lb/bbl

Of course, a wide variety of different formulations may be used for the barrier substance 74. The above are only two such formulations, and it should be clearly understood that the principles of this disclosure are not limited at all to these formulations.

Figure 4:
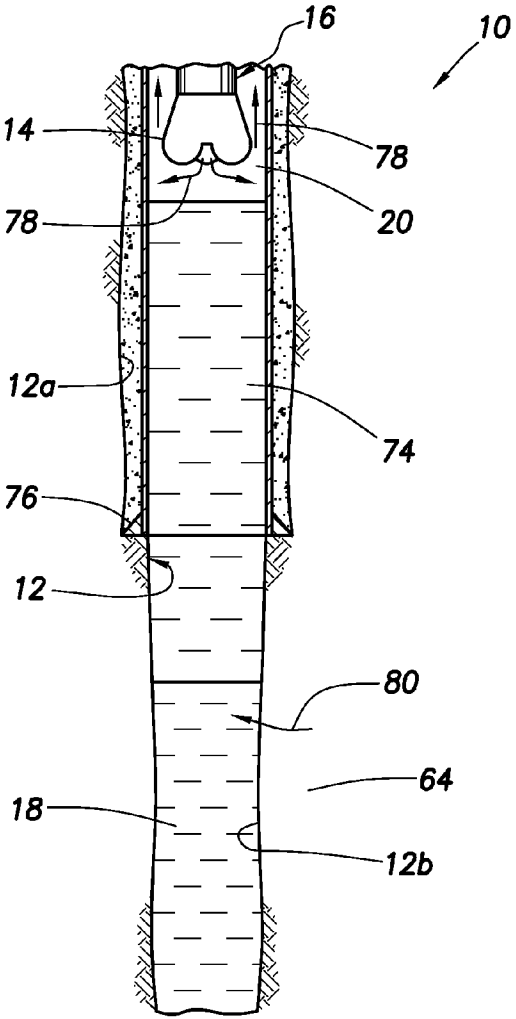
FIG. 4 is a schematic cross-sectional view of the well system in which further steps of the method have been performed.

Referring additionally now to FIG. 4, the system 10 is representatively illustrated after the barrier substance 74 has been placed in the wellbore 12 and the tubular string 16 has been further partially withdrawn from the wellbore. Another fluid 78 is then flowed into the wellbore 12 on an opposite side of the barrier substance 74 from the fluid 18.

The fluid 78 preferably has a density greater than a density of the fluid 18. By flowing the fluid 78 into the wellbore 12 above the barrier substance 74 and the fluid 18, a desired pressure can be maintained in the fluid 18 exposed to the formation 64, as the tubular string 16 is tripped out of and back into the wellbore, as a completion assembly is installed, as a logging operation is performed, as casing is installed, etc.

The density of the fluid 78 is selected so that, after it is flowed into the wellbore 12 (e.g., filling the wellbore from the barrier substance 74 to the surface), an appropriate hydrostatic pressure will be thereby applied to the fluid 18 exposed to the formation 64. Preferably, at any selected location along the uncased portion 12*b* of the wellbore 12, the pressure in the fluid 18 will be equal to, or only marginally greater than (e.g., no more than approximately 100 psi greater than), pore pressure in the formation 64. However, other pressures in the fluid 18 may be used in other examples.

While the barrier substance 74 is being placed in the wellbore 12, and while the fluid 78 is being flowed into the wellbore, the control system 90 preferably maintains the pressure in the fluid 18 exposed to the formation 64 substantially constant (e.g., varying no more than a few psi). The control system 90 can achieve this result by automatically adjusting the choke 34 as fluid exits the annulus 20 at the surface, as described above, so that an appropriate backpressure is applied to the annulus at the surface to maintain a desired pressure in the fluid 18 exposed to the formation 64.

Note that, since different density substances (e.g., barrier substance 74 and fluid 78) are being introduced into the wellbore 12, the annulus pressure setpoint will vary as the substances are introduced into the wellbore. Preferably, the density of the fluid 78 is selected so that, upon completion of the step of flowing the fluid 78 into the wellbore 12, no pressure will need to be applied to the annulus 20 at the surface in order to maintain the desired pressure in the fluid 18 exposed to the formation 64.

In this manner, a snubbing unit will not be necessary for subsequent well operations (such as, running casing, installing a completion assembly, wireline or coiled tubing logging, etc.). However, a snubbing unit may be used, if desired.

Preferably, the barrier fluid 74 will prevent mixing of the fluids 18, 78, will isolate the fluids from each other, will prevent migration of gas 80 upward through the wellbore 12, and will transmit pressure between the fluids. Consequently, excessively increased pressure in the uncased portion 12*b* of the wellbore exposed to the formation 64 (which could otherwise result from opening a downhole deployment valve, etc.) can be prevented, excessively reduced pressure can be prevented from being exposed to the uncased portion of the wellbore, gas in the fluid 18 can be prevented from migrating upwardly through the wellbore to the surface, and fluids (such as higher density fluids) other than the fluid 18 can be prevented from contacting the exposed formation.

Figure 5:
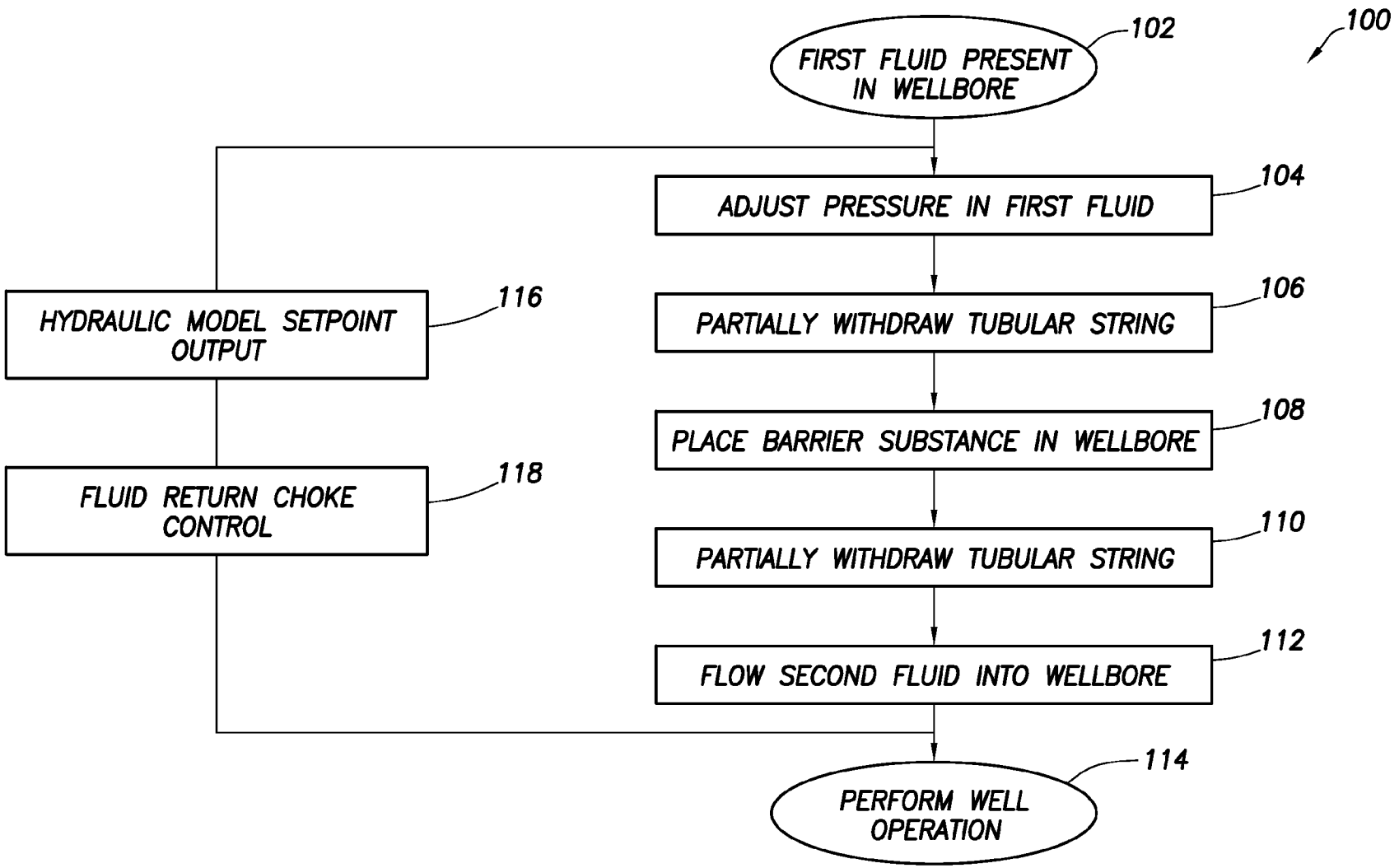
FIG. 5 is a schematic view of a flowchart for the method.

Referring additionally now to FIG. 5, a flowchart for one example of a method 100 of controlling pressure in the wellbore 12 is representatively illustrated. The method 100 may be used in conjunction with the well system 10 described above, or the method may be used with other well systems.

In an initial step 102 of the method 100, a first fluid (such as the fluid 18) is present in the wellbore 12. As in the system 10, the fluid 18 could be a drilling fluid which is specially formulated to exert a desired hydrostatic pressure, prevent fluid loss to the formation 64, lubricate the bit 14, enhance wellbore stability, etc. In other examples, the fluid 18 could be a completion fluid or another type of fluids.

The fluid 18 may be circulated through the wellbore 12 during drilling or other operations. Various means (e.g., tubular string 16, a coiled tubing string, etc.) may be used to introduce the fluid 18 into the wellbore, in keeping with the principles of this disclosure.

In a subsequent step 104 of the method 100, pressure in the fluid 18 exposed to the formation 64 is adjusted, if desired. For example, if prior to beginning the procedure depicted in FIG. 5, an underbalanced drilling operation was being performed, then it may be desirable to increase the pressure in the fluid 18 exposed to the formation 64, so that the pressure in the fluid is equal to, or marginally greater than, pore pressure in the formation.

In this manner, an influx of fluid from the formation 64 into the wellbore 12 can be avoided during the remainder of the method 100. Of course, if the pressure in the fluid 18 exposed to the formation 64 is already at a desired level, then this step 104 is not necessary.

In step 106 of the method 100, the tubular string 16 is partially withdrawn from the wellbore 12. This places a lower end of the tubular string 16 at a desired lower extent of the barrier substance 74, as depicted in FIG. 3.

If the lower end of the tubular string 16 (or another tubular string used to place the barrier substance 74) was not previously below the desired lower extent of the barrier substance, then "partially withdrawing" the tubular string can be taken to mean, "placing the lower end of the tubular string at a desired lower extent of the barrier substance 74." For example, a coiled tubing string could be installed in the wellbore 12 for the purpose of placing the barrier substance 74 above the fluid 18 exposed to the formation 64, in which case the coiled tubing string could be considered "partially withdrawn" from the wellbore, in that its lower end would be positioned at a desired lower extent of the barrier substance.

In step 108 of the method 100, the barrier substance 74 is placed in the wellbore 12. As described above, the barrier substance could be flowed through the tubular string 16, flowed through the annulus 20 or placed in the wellbore by any other means.

In step 110 of the method 100, the tubular string 16 is again partially withdrawn from the wellbore 12. This time, the lower end of the tubular string 16 is positioned at a desired lower extent of the fluid 78. In this step 110, "partially withdrawing" can be taken to mean, "positioning a lower end of the tubular string at a desired lower extent of the fluid 78."

In step 112 of the method 100, the second fluid 78 is flowed into the wellbore 12. As described above, the fluid 78 has a selected density, so that a desired pressure is applied to the fluid 18 by the column of the fluid 78 thereabove. It is envisioned that, in most circumstances of underbalanced and managed pressure drilling, the density of the fluid 78 will be greater than the density of the fluid 18 (so that the pressure in the fluid 18 is equal to or marginally greater than the pressure in the formation 64), but in other examples the density of the fluid 78 could be equal to, or less than, the density of the fluid 18.

In step 114 of the method 100, a well operation is performed at the conclusion of the procedure depicted in FIG. 5. The well operation could be any type, number and/or combination of well operation(s) including, but not limited to, drilling operation(s), completion operation(s), logging operation (s), installation of casing, etc. Preferably, due to the unique features of the system and method described herein, such operation(s) can be performed without use of a downhole deployment valve or a surface snubbing unit, but those types of equipment may be used, if desired, in keeping with the principles of this disclosure.

Throughout the method 100, and as indicated by steps 116 and 118 in FIG. 5, the hydraulics model 92 produces a desired surface annulus pressure setpoint as needed to maintain a desired pressure in the fluid 18 exposed to the formation 64, and the controller 96 automatically adjusts the choke 34 as needed to achieve the surface annulus pressure setpoint. The surface annulus pressure setpoint can change during the method 100.

For example, if the fluid 78 has a greater density than the fluid 18 in step 112, then the surface annulus pressure setpoint may decrease as the fluid 78 is flowed into the wellbore 12. As another example, in step 104, the surface annulus pressure setpoint may be increased if the wellbore 12 was previously being drilled underbalanced, and it is now desired to increase the pressure in the fluid 18 exposed to the formation 64, so that it is equal to or marginally greater than pressure in the formation.

Note that, although in the above description only the fluids 18, 78 are indicated as being segregated by the barrier substance 74, in other examples more than one fluid could be exposed to the formation 64 below the barrier substance and/or more than one fluid may be positioned between the barrier substance and the surface. In addition, more than one barrier substance 74 and/or barrier substance location could be used in the wellbore 12 to thereby segregate any number of fluids.

It may now be fully appreciated that the above description of the various examples of the well system 10 and method 100 provides several advancements to the art of wellbore pressure control. Pressure applied to a formation by fluid in a wellbore intersecting the formation can be precisely controlled and the fluid exposed to the formation during various well operations can be optimized, thereby preventing damage to the formation, loss of fluids to the formation, undesired influx of fluids from the formation, etc.

The above disclosure describes a method 100 of controlling pressure in a wellbore 12. The method 100 can include placing a barrier substance 74 in the wellbore 12 while a first fluid 18 is present in the wellbore, and flowing a second fluid 78 into the wellbore 12 while the first fluid 18 and the barrier substance 74 are in the wellbore. The first and second fluids 18, 78 may have different densities.

The barrier substance 74 may isolate the first fluid 18 from the second fluid 78, may prevent upward migration of gas 80 in the wellbore and/or may prevent migration of gas 80 from the first fluid 18 to the second fluid 78.

The barrier substance 74 may comprises a thixotropic gel and/or a gel which sets in the wellbore 12. The barrier substance 74 may have a viscosity greater than viscosities of the first and second fluids 18, 78.

Placing the barrier substance 74 in the wellbore 12 can include automatically controlling a fluid return choke 34, whereby pressure in the first fluid 18 is maintained substantially constant. Similarly, flowing the second fluid 78 into the wellbore 12 can include automatically controlling the fluid return choke 34, whereby pressure in the first fluid 18 is maintained substantially constant.

The second fluid 78 density may be greater than the first fluid 18 density. Pressure in the first fluid 18 may remain substantially constant while the greater density second fluid 78 is flowed into the wellbore 12.

Also described by the above disclosure is a method 100 of controlling pressure in a wellbore 12, with the method including: circulating a first fluid 18 through a tubular string 16 and an annulus 20 formed between the tubular string 16 and the wellbore 12; then partially withdrawing the tubular string 16 from the wellbore 12; then placing a barrier substance 74 in the wellbore 12; then further partially withdrawing the tubular string 16 from the wellbore 12; and then flowing a second fluid 78 into the wellbore 12.

Pressure in the first fluid 18 may be maintained substantially constant during placing the barrier substance 74 in the wellbore 12 and/or during flowing the second fluid 78 into the wellbore.

The method 100 can include, prior to placing the barrier substance 74 in the wellbore 12, adjusting a pressure in the first fluid 18 exposed to a formation 64 intersected by the wellbore 12, whereby the pressure in the first fluid 18 at a selected location is approximately the same as, or marginally greater than, a pore pressure of the formation 64 at the selected location.

The above disclosure also provides to the art a well system 10. The well system 10 can include first and second fluids 18, 78 in a wellbore 12, the first and second fluids having different densities, and a barrier substance 74 separating the first and second fluids.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the above description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of controlling pressure in a wellbore, the method comprising:

placing a barrier substance in the wellbore while a first fluid is present in the wellbore; and flowing a second fluid into the wellbore while the first fluid and the barrier substance are in the wellbore, wherein the barrier substance isolates the first fluid from the second fluid after the barrier substance sets in the wellbore, and wherein the barrier substance transmits pressure between the first and second fluids after the barrier substance sets in the wellbore.

2. The method of claim 1, wherein the first and second fluids have different densities.

3. The method of claim 1, wherein the barrier substance prevents upward migration of gas in the wellbore.

4. The method of claim 1, wherein the barrier substance prevents migration of gas from the first fluid to the second fluid.

5. The method of claim 1, wherein the barrier substance comprises a thixotropic gel.

6. The method of claim 1, wherein the barrier substance comprises a gel which sets in the wellbore.

7. The method of claim 1, wherein the barrier substance has a viscosity greater than viscosities of the first and second fluids.

8. The method of claim 1, wherein placing the barrier substance in the wellbore further comprises automatically controlling a fluid return choke, whereby pressure in the first fluid is maintained substantially constant.

9. The method of claim 1, wherein flowing the second fluid into the wellbore further comprises automatically controlling a fluid return choke, whereby pressure in the first fluid is maintained substantially constant.

10. A method of controlling pressure in a wellbore, the method comprising:

placing a barrier substance in the wellbore while a first fluid is present in the wellbore; and flowing a second fluid into the wellbore while the first fluid and the barrier substance are in the wellbore, the first and second fluids having different densities, and wherein the second fluid density is greater than the first fluid density.

11. The method of claim 10, wherein pressure in the first fluid remains substantially constant while the greater density second fluid is flowed into the wellbore.

12. A well system, comprising:

first and second fluids in a wellbore; and a barrier substance separating the first and second fluids, wherein the barrier substance isolates the first fluid from the second fluid after the barrier substance sets in the wellbore, and wherein the barrier substance transmits pressure between the first and second fluids after the barrier substance sets in the wellbore.

13. The system of claim 12, wherein the first and second fluids have different densities.

14. The system of claim 12, wherein the barrier substance prevents upward migration of gas in the wellbore.

15. The system of claim 12, wherein the barrier substance prevents migration of gas from the first fluid to the second fluid.

16. The system of claim 12, wherein the barrier substance comprises a thixotropic gel.

17. The system of claim 12, wherein the barrier substance comprises a gel which sets in the wellbore.

18. The system of claim 12, wherein the barrier substance has a viscosity greater than viscosities of the first and second fluids.

* * * * *

UNITED STATES PATENT AND TRADEMARK OFFICE

CERTIFICATE OF CORRECTION

PATENT NO. : 8,201,628 B2
APPLICATION NO. : 13/084841
DATED : June 19, 2012
INVENTOR(S) : James R. Lovorn et al.

It is certified that error appears in the above-identified patent and that said Letters Patent is hereby corrected as shown below:

Title page, in a new item 30, "Foreign Application Priority Data" section, insert -- 27 April 2010 (WO) ..... PCT/US10/32578 --.

Signed and Sealed this
Twenty-third Day of October, 2012

David J. Kappos

David J. Kappos
*Director of the United States Patent and Trademark Office*